US007129938B2

(12) United States Patent
Naugler, Jr.

(10) Patent No.: US 7,129,938 B2
(45) Date of Patent: Oct. 31, 2006

(54) LOW POWER CIRCUITS FOR ACTIVE MATRIX EMISSIVE DISPLAYS AND METHODS OF OPERATING THE SAME

(75) Inventor: W. Edward Naugler, Jr., Cedar Park, TX (US)

(73) Assignee: Nuelight Corporation, Santa Clara, CA (US)

( * ) Notice: Subject to any disclaimer, the term of this patent is extended or adjusted under 35 U.S.C. 154(b) by 71 days.

(21) Appl. No.: 11/101,270

(22) Filed: Apr. 6, 2005

(65) Prior Publication Data

US 2005/0225519 A1 Oct. 13, 2005

Related U.S. Application Data

(60) Provisional application No. 60/561,474, filed on Apr. 12, 2004.

(51) Int. Cl.
*G09G 5/00* (2006.01)
*G09G 3/30* (2006.01)
*G09G 3/32* (2006.01)

(52) U.S. Cl. ..... 345/207; 345/76; 345/82

(58) Field of Classification Search ..... 345/76, 345/77, 82, 83, 207; 315/169.1, 169.3
See application file for complete search history.

(56) References Cited

U.S. PATENT DOCUMENTS 3,631,411 A * 12/1971 Kosonocky ..... 365/238
4,587,459 A 5/1986 Blake
4,655,552 A 4/1987 Togashi et al.
4,897,672 A 1/1990 Horiuchi et al.
4,951,041 A 8/1990 Inada et al.
4,975,691 A 12/1990 Lee
5,075,596 A 12/1991 Young et al.
5,093,654 A 3/1992 Swift et al.
5,121,146 A 6/1992 Smith et al.
5,231,382 A 7/1993 Tanaka
5,235,243 A 8/1993 Sato
5,283,500 A 2/1994 Kochanski
5,287,205 A 2/1994 Yamazaki et al.
5,323,408 A 6/1994 Hahn et al.
5,357,172 A 10/1994 Lee et al.
5,386,179 A 1/1995 Sato
5,387,844 A 2/1995 Browning (Continued)

FOREIGN PATENT DOCUMENTS

EP 0 923 067 A1 6/1998

(Continued)

*Primary Examiner*—Richard Hjerpe
*Assistant Examiner*—Kevin M. Nguyen
(74) *Attorney, Agent, or Firm*—Howrey LLP; Vinay V. Joshi

(57) ABSTRACT

The embodiments of the present invention provide a flat panel display having a plurality of pixels, each comprising a light-emitting device configured to emit light in accordance with a current flowing through the light-emitting device, a transistor coupled to the light-emitting device and configured to provide the current through the light-emitting device, the current increasing with a ramp voltage applied to a control terminal of the transistor, and a switching device configured to switch off in response to the luminance of the light-emitting device having reached a specified level, thereby disconnecting the ramp voltage from the transistor and locking the brightness at the specified level. The switching device is further configured to stay off thereby allowing the luminance of the light-emitting device to be kept at the specified level until the pixel is rewritten in a different frame.

20 Claims, 9 Drawing Sheets

U.S. PATENT DOCUMENTS

| | | | | |
|---|---|---|---|---|
| 5,396,150 | A | 3/1995 | Wu et al. | |
| 5,410,218 | A | 4/1995 | Hush | |
| 5,463,279 | A | 10/1995 | Khormaei | |
| 5,581,159 | A | 12/1996 | Lee et al. | |
| 5,594,463 | A | 1/1997 | Sakamoto | |
| 5,661,645 | A | 8/1997 | Hochstein | |
| 5,739,641 | A | 4/1998 | Nakamura et al. | |
| 5,751,267 | A | 5/1998 | Sato et al. | |
| 5,754,150 | A | 5/1998 | Matsui | |
| 5,783,909 | A | 7/1998 | Hochstein | |
| 5,940,058 | A | 8/1999 | Koyama | |
| 5,962,845 | A | 10/1999 | Yee | |
| 5,973,456 | A | 10/1999 | Osada et al. | |
| 6,081,073 | A | 6/2000 | Abdel | |
| 6,229,506 | B1 | 5/2001 | Dawson et al. | |
| 6,229,508 | B1 | 5/2001 | Kane | |
| 6,320,325 | B1 | 11/2001 | Cok | |
| 6,392,617 | B1 * | 5/2002 | Gleason | 345/82 |
| 6,396,217 | B1 | 5/2002 | Weindorf | |
| 6,414,661 | B1 | 7/2002 | Shen et al. | |
| 6,417,825 | B1 * | 7/2002 | Stewart et al. | 345/77 |
| 6,441,560 | B1 | 8/2002 | Hunter | |
| 6,483,492 | B1 | 11/2002 | Takeuchi et al. | |
| 6,489,631 | B1 | 12/2002 | Young et al. | |
| 6,498,592 | B1 | 12/2002 | Matthies | |
| 6,501,230 | B1 | 12/2002 | Feldman | |
| 6,518,941 | B1 | 2/2003 | Kimura | |
| 6,518,962 | B1 | 2/2003 | Kimura | |
| 6,522,315 | B1 | 2/2003 | Ozawa et al. | |
| 6,529,178 | B1 | 3/2003 | Kimura | |
| 6,529,213 | B1 | 3/2003 | Kimura | |
| 6,542,137 | B1 | 4/2003 | Kimura et al. | |
| 6,542,138 | B1 | 4/2003 | Shannon | |
| 6,603,499 | B1 | 8/2003 | Wong et al. | |
| 6,618,185 | B1 | 9/2003 | Sandström | |
| 6,642,665 | B1 | 11/2003 | Kimura | |
| 6,693,610 | B1 | 2/2004 | Shannon et al. | |
| 6,720,942 | B1 | 4/2004 | Lee et al. | |
| 6,738,031 | B1 | 5/2004 | Young et al. | |
| 6,781,567 | B1 | 8/2004 | Kimura | |
| 6,812,651 | B1 * | 11/2004 | Iwata et al. | 315/169.3 |
| 7,061,452 | B1 * | 6/2006 | Inoue et al. | 345/76 |
| 2004/0222954 | A1 * | 11/2004 | Lueder | 345/87 |

FOREIGN PATENT DOCUMENTS

| | | |
|---|---|---|
| JP | 2002-144634 | 5/2002 |
| WO | WO 99/53472 | 10/1999 |
| WO | WO 03/038790 A2 | 5/2003 |
| WO | WO 03/038798 A2 | 5/2003 |
| WO | WO 2004/027744 A1 | 4/2004 |
| WO | WO 2004/072937 A2 | 8/2004 |
| WO | WO 2004/072938 A2 | 8/2004 |
| WO | WO 2004/072940 A1 | 8/2004 |
| WO | WO 2004/084168 A1 | 9/2004 |

* cited by examiner

The $I_D - V_D$ diagram for a TFT with saturation for $V_D \geqq V_G - V_{th}$

LOW POWER CIRCUITS FOR ACTIVE MATRIX EMISSIVE DISPLAYS AND METHODS OF OPERATING THE SAME

CROSS REFERENCE TO RELATED APPLICATIONS

The present application claims priority to U.S. Provisional Patent Application No. 60/561,474 entitled "Low Power Circuit for Active Matrix Emissive Flat Panel Displays," filed on Apr. 12, 2004, the entire disclosure of which is incorporated herein by reference.

The present application is related to commonly assigned U.S. patent application, entitled "Color Filter Integrated with Sensor Array for Flat Panel Display," filed Apr. 6, 2005, commonly assigned U.S. patent application Ser. No. 10/872,344, entitled "Method and Apparatus for Controlling an Active Matrix Display," filed Jun. 17, 2004, and commonly assigned U.S. patent application Ser. No. 10/841,198 entitled "Method and Apparatus for Controlling Pixel Emission," filed May 6, 2004, each of which is incorporated herein by reference.

FIELD OF THE INVENTION

The present invention relates to active matrix emissive displays and particularly to low power circuits for active matrix emissive displays and methods of operating the same.

BACKGROUND OF THE INVENTION

The active matrix display employs a thin film circuit at each pixel that allows each pixel in the display to be directly addressed. In a typical active matrix liquid crystal display (AMLCD), each pixel circuit includes a data thin film transistor (TFT) T1 connected between a data line $V_{data}$ and a liquid crystal display cell LCD and storage capacitor C pair, as shown in FIG. 1. The thin film transistor has a control gate G1 connected to an enable voltage $V_{enable}$. During operation, a data voltage $V_{data}$ is placed on drain D of transistor T1 and, when gate G1 is activated, data voltage $V_{data}$ is transferred to storage capacitor C and liquid crystal cell LCD though TFT T1. The power dissipated during the charging of capacitor C and liquid crystal display cell LCD is usually negligible. The power problem in the AMLCD is typically in a backlight circuit that supplies the light, which the LCD modulates. In the case of active matrix emissive displays, particularly the active matrix organic light emitting displays (AMOLED), significant amount of power is consumed to produce light emissions from the pixels, and additional power is required to operate driving circuits in the active matrix, which control the light emissions.

With reference to FIG. 2, a typical driving circuit of an organic light-emitting diode (OLED) active matrix emissive display includes an OLED D1 and a power TFT T2 serially coupled with each other between a voltage supply $V_{DD}$ and ground. TFT T2 has a source S connected to OLED D1, a drain D connected to voltage supply $V_{DD}$, and a gate G2 connected to TFT T1. Capacitor C is coupled between the source S and gate G2 of TFT T2. OLED D1 has parasitic resistor $R_D$ and parasitic capacitor $C_D$. TFT T2 supplies current $I_D$ to OLED D1. The level of emissions from OLED D1, or, in a more scientific term, the luminance of OLED D1, is proportional to the current $I_D$. Since the voltage across TFT T2 and OLED D1 is equal to $V_{DD}$, the power P dissipated by TFT T2 and OLED D1 is equal to $V_{DD}$ times the current $I_D$ While the voltage supply $V_{DD}$ is divided between TFT T2 and OLED D1, the same current $I_D$ flows through both. Therefore, the power P is divided between TFT T2 and OLED D1 in proportion to the voltage $V_{DD}$ being divided between them.

Before any current is supplied to OLED D1 by TFT T2, the source S of TFT T2 is at ground state causing the voltage $V_{DD}$ to fall almost entirely across TFT T2. As current $I_D$ increases in OLED D1, the voltage $V_D$ across TFT T2 decreases, while the sum of the voltage across OLED D1 and voltage $V_D$ equals $V_{DD}$. A problem arises because OLED D1 is a load on TFT T2, which load is changing during operation, as every level of luminance from OLED D1 requires a specific current $I_D$, and thus, represents a different load to TFT T2. In order to faithfully convert data voltage $V_{data}$ to a specified current $I_D$ and a specified luminance of OLED D1 corresponding to $V_{data}$, changes in the load of TFT T2 due to changes in the luminance of OLED D1 should not cause changes in current $I_D$ output from TFT T2. That is, TFT T2 should act as a current source and not change current output as the load changes. In order for TFT T2 to act as a current source, voltage $V_D$ across TFT T2 must bias TFT T2 in the saturation mode. As shown in FIG. 3, the saturation mode corresponds to the flat part of each $I_D$ versus $V_D$ curve, while the steep slope leading up to the flat part corresponds to the unsaturated mode.

In the saturation mode, $I_D$ depends almost entirely on $V_G$, which is the voltage on gate G of TFT T2, as expressed in Eq. 1:

$$I_D = \frac{\mu \cdot \epsilon_0 \cdot \epsilon_r \cdot w}{2 \cdot d \cdot 1}(V_G - V_{th})^2 \tag{1}$$

where $\mu, \epsilon_0, \epsilon_r$, W, l, d, and $V_{th}$ are parameters associated with TFT T2. with $\mu$ being the effective electron mobility, $\epsilon_0$ being the permittivity of free space, $\epsilon_r$ being the dielectric constant of the gate dielectric, w being the TFT channel width, l being the TFT channel length, d being the gate dielectric thickness, and $V_{th}$ being the threshold voltage.

For a TFT to be in the saturation mode, $V_D$ must be greater than $V_G - V_{th}$. Thus, for a specified current $I_D$ $$V_D > V_G - V_{th} = \sqrt{I_D \frac{2 \cdot d \cdot 1}{\mu \cdot (\epsilon_0 \cdot \epsilon_r \cdot w)}} \tag{2}$$

Typically, 1 μA of current is sufficient to give bright emissions from an OLED pixel. Following are examples of TFT parameters:

$V_{th} \approx 1$ V
$\mu \approx 0.75$ cm$^2$/V·sec
$\epsilon_r \approx 4$
$w \approx 25$ μm
$1 \approx 5$ μm
$d \approx 0.18$ μm from which it is estimated that:

$V_D < V_G - V_{th} \approx 5.206$V, for $I_D = 1$ μA.

This means that the minimum $V_D$ required to put TFT T2 in saturation is about 5.2V for a drain current of 1 μA, or that at $I_D = 1$ μA, the power dissipated by TFT T2 is about 5.2 microwatts. This estimate is for an ideal situation. In practice, a larger voltage across the OLED is needed to pass 1 μA of current through the OLED as the OLED ages. For example, when an OLED is new, only about 4 V across the OLED is required to pass 1 μA of current, but as it ages this voltage may increase to as high as 6 volts. This means that 2 extra volts should typically be added to $V_{DD}$ to ensure that TFT T2 stays in saturation over the lifetime of the display. In addition, if higher OLED luminance is desired, higher $V_D$ will be required to ensure saturation. Furthermore, even higher $V_D$ may be required to keep TFT T2 in saturation due to threshold voltage drift, which often happens with amorphous silicon TFTs. Thus, the total required voltage $V_D$ is about 5.2 V for an ideal case when 1 μA of drain current is generated in the saturation mode, plus about 2 volts for threshold voltage drift and about an additional 2 volts for OLED aging and maximum OLED brightness. This means that $V_{DD}$ needs to be as high as about 13.2 volts. This also means that when the display is new, for 1 microampere of current through the OLED D1, there will be about 4 volts across the OLED and about 4 microwattts of power dissipation by the OLED, while about 9.2 volts of voltage is across TFT T2 and power dissipation by the TFT is about 9.2 microwatts, which is more than twice the power dissipation of the OLED itself.

Thus, there is a need for a display that provides good control of pixel luminance without excessive power dissipation by the power TFTs.

SUMMARY OF THE INVENTION

The embodiments of the present invention provide a display having a plurality of pixels. Each pixel comprises a light-emitting device configured to emit light or photons in response to a current flowing through the light-emitting device. The luminance of the light-emitting device depends on the current through the light-emitting device. Each pixel further comprises a transistor coupled to the light-emitting device and configured to provide the current through the light-emitting device, the current increasing with a ramp voltage applied to a control terminal of the transistor, and a switching device configured to switch off in response to the luminance of the light-emitting device having reached a specified level, thereby disconnecting the ramp voltage from the transistor and locking the brightness at the specified level. The switching device is further configured to stay off thereby allowing the luminance of the light-emitting device to be kept at the specified level until the pixel is rewritten in the next frame.

In some embodiments, the transistor and the light-emitting device are serially coupled with each other between a variable voltage source and ground. The variable voltage source is configured to output a voltage that changes as the display ages. The voltage output from the variable voltage source changes based on a statistical evaluation of the changes in ramp voltages required to cause the light from the light-emitting devices to reach specified levels in brightness in some or all of the pixels in the display.

The embodiments of the present invention also provide a method for controlling the brightness of a pixel in a display. The method comprises switching on a switching device by applying a first control voltage to a first control terminal and a second control voltage to a second control terminal of the switching device, and applying a ramp voltage through the switching device to a gate of a transistor serially coupled with the light-emitting device thereby causing light emitted from the light-emitting device to increase in brightness with the ramp voltage. The light from the light-emitting device illuminates an optical sensor thereby causing an electrical parameter associated with the optical sensor to change as the light changes in brightness, and the second control voltage is dependent on the electrical parameter and changes to a different value in response to the luminance of the light-emitting device having reached a specified brightness for the pixel, thereby switching off the switching device.

In some embodiments, the transistor and the light-emitting device are serially coupled with each other between a variable voltage source and ground, and the method further comprises varying a voltage output from the variable voltage source as the display ages. The voltage output is varied by recording a value of ramp voltage required to cause the light-emitting device in each pixel in the display to reach the specified level of brightness for the pixel, and computing a statistical measure from the changes in the recorded values for some or all of the pixels in the display to determine when and how much to change the voltage output.

The embodiments described herein provide significant power savings by allowing a power TFT, that supplies currents to a light-emitting device such as an OLED in a pixel of a display, to operation in the unsaturated regions associated with its current-voltage characteristics, because the brightness of the light-emitting device according to embodiments of the present invention does not depend on a current-voltage relationship of the power TFT, but on the pixel brightness itself. Further power savings are achieved in embodiments using variable power supplies.

DETAILED DESCRIPTION OF THE EMBODIMENTS

Embodiments of the present invention provide low-power circuits for emissive displays and methods of operating the same. The embodiments described herein save power consumed by power TFTs that supply currents to light-emitting devices in a display by allowing the power TFTs to operate in the unsaturated region.

Figure 4A:
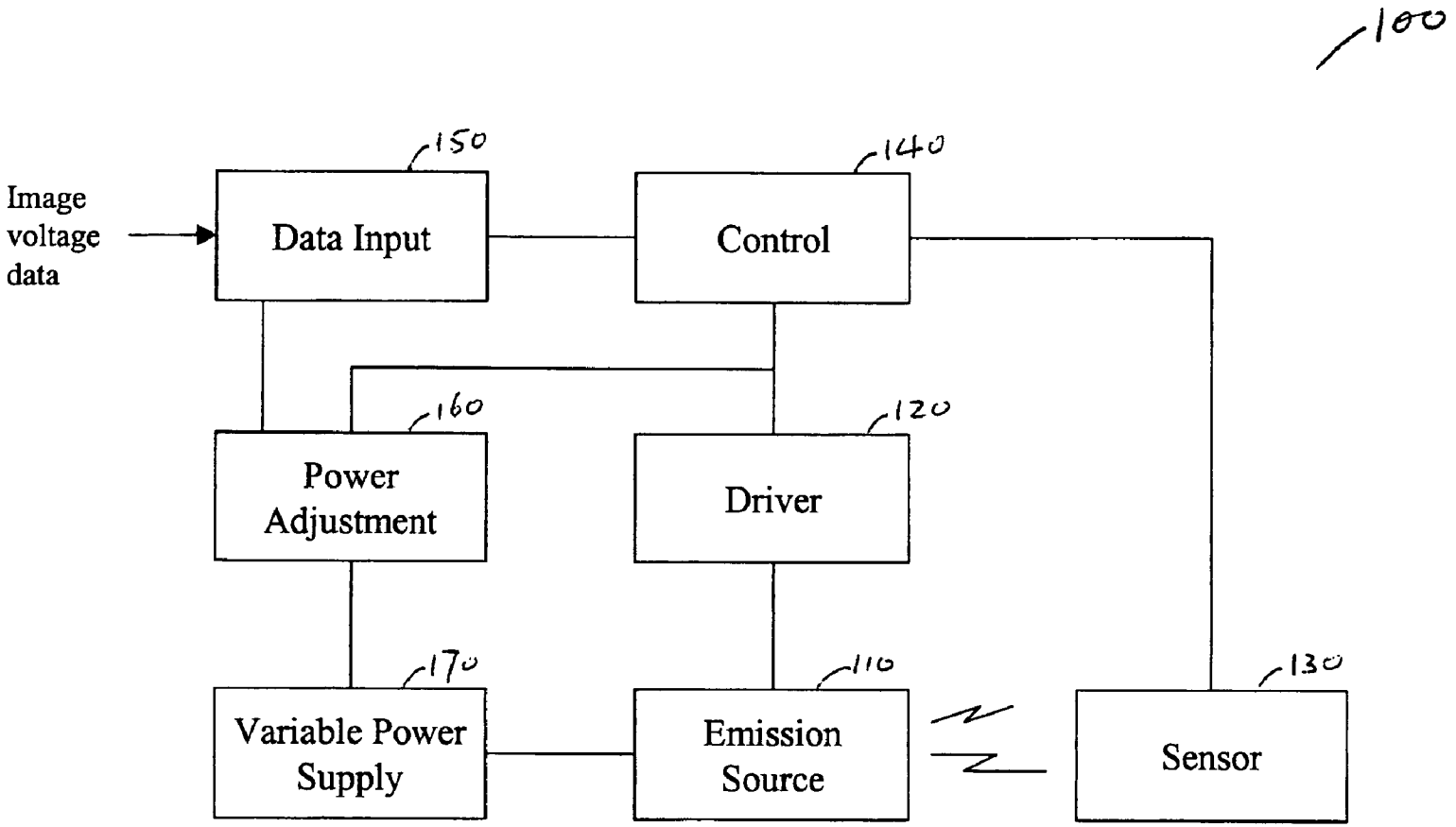
FIG. 4A is a block diagram of an emissive feedback circuit in a display according to one embodiment of the present invention.

FIG. 4A is a block diagram of a portion of an exemplary circuit 100 for a display, such as a flat panel display, according to one embodiment of the present invention. As shown in FIG. 4A, display circuit 100 comprises a light emission source 110, an emission driver 120 configured to vary the luminance of the emission source 110, an optical sensor 130 positioned to receive a portion of the light emitted from emission source 110 and having an associated electrical parameter dependent on the received light, a control unit 140 configured to control the driver 120 based on the changes in the electrical parameter of the sensor 130, and a data input unit 150 configured to provide a signal corresponding to a desired brightness level for the emission source 110 to the control unit 140. Optionally, display circuit 100 may further comprise a power adjustment unit 160 configured to adjust the amount of power produced by a variable power supply 170, which is the source of power for the emission source 110, to account for variations in the emission source and other circuit elements in display circuit 100.

Sensor 130 may comprise any sensor material having a measurable property, such as a resistance, capacitance, inductance, etc., dependent on received emissions. In one example, sensor 130 comprises a photosensitive resistor whose resistance varies with an incident photon flux. As another example, the sensor 130 comprises a calibrated photon flux integrator, such as the one disclosed in commonly assigned U.S. patent application Ser. No. 11/016,372 entitled "Active-Matrix Display and Pixel Structure for Feedback Stabilized Flat Panel Display," filed on Dec. 17, 2004, which is incorporated herein by reference in its entirety. Sensor 130 may also or alternatively comprise one or more of other radiation-sensitive sensors including, but not limited to, optical diodes and/or optical transistors. Thus, sensor 130 may comprise at least one type of material that has one or more electrical properties changing according to the intensity of radiation falling or impinging on a surface of the material. Such materials include but are not limited to amorphous silicon (a-Si), cadmium selenide (CdSe), silicon (Si), and Selenium (Se). Sensor 130 may also comprise other circuit elements such as an isolation transistor for preventing cross talk among a plurality of sensors 130 in an active matrix display, as discussed in more detail below.

The control unit 140 may be implemented in hardware, software, or a combination thereof. In one embodiment, the control unit 140 is implemented using a voltage comparator. Other comparison circuitry or software may also or alternatively be used. The driver 120 may include any hardware, software, firmware, or combinations thereof suitable for providing a drive signal to emission source 110. Driver 120 may be integrated with a display substrate on which the emission source 110 is formed, or it may be separate from the display substrate. In some embodiments, portions of driver 120 are formed on the display substrate.

During operation of display circuit 100, data input 150 receives image voltage data corresponding to a desired brightness of the light from emission source 110 and converts the image voltage data to a reference voltage for use by the control unit 140. The pixel driver 120 is configured to vary the light emission from the emission source 110 until the electrical parameter in sensor 130 reaches a certain value corresponding to the reference voltage, at which point, control unit 140 couples a control signal to driver 120 to stop the variation of the light emission. Driver 120 also comprises mechanisms for maintaining the light emission from emission source 110 at the desired brightness after the variation of the light emission is stopped. Optionally, while the light emission from the emission source 110 is varied, an electrical measure in the power adjustment unit is also varied accordingly, and the control signal from the control unit 140 is also coupled to the power adjustment unit 160 to stop the variation of the electrical measure. Based on the value at which the electrical measure is stopped, the power adjustment unit 160 determines whether to adjust the variable power supply 170 and how much adjustment needs to be done using, for example, a statistical technique, as explained in more detail below.

Figure 5:
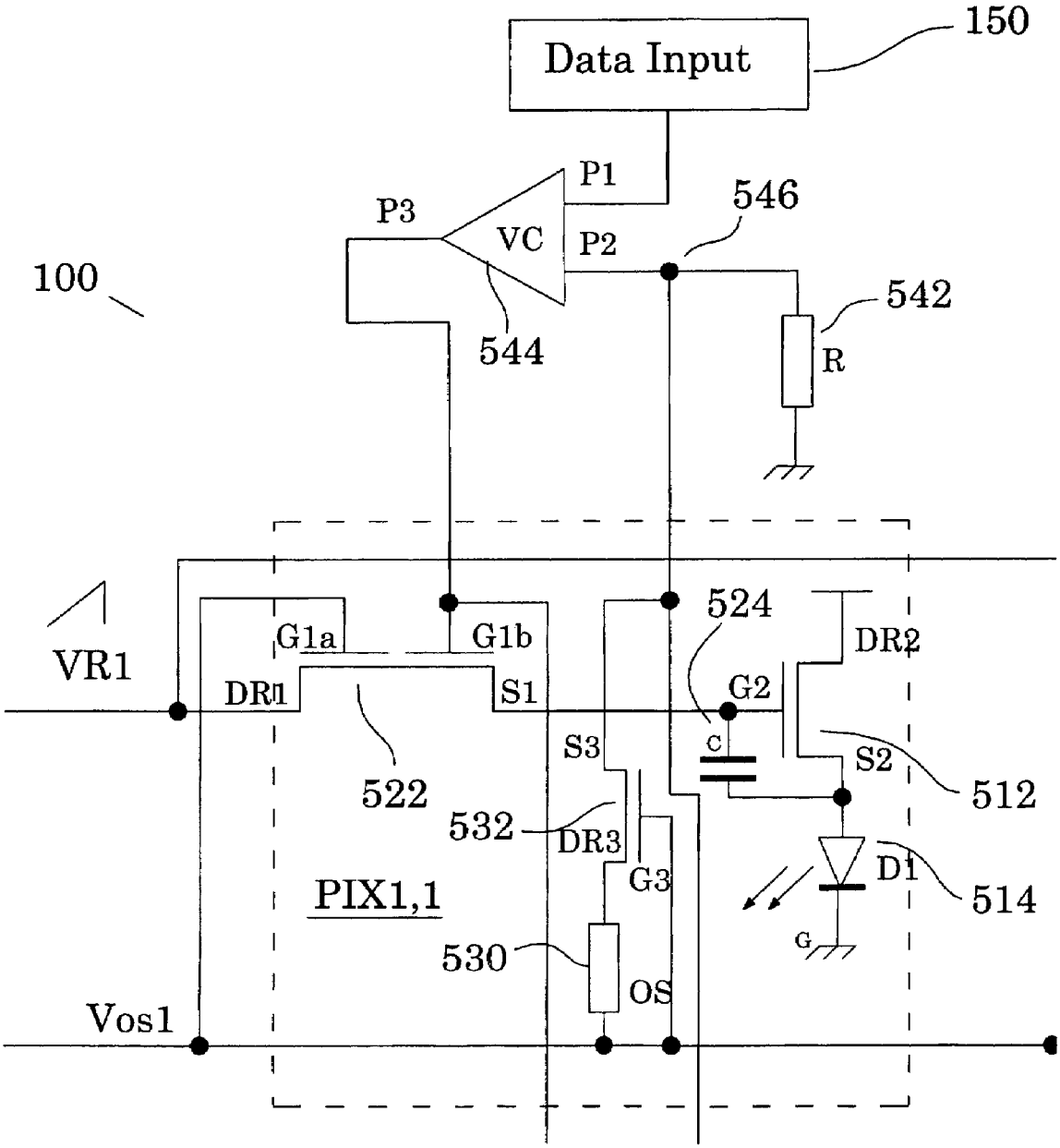
FIG. 5 is a schematic diagram of a portion of a display circuit according to one embodiment of the present invention.

FIG. 5 illustrates one implementation of the display circuit 100 in the embodiments of FIG. 4A. As shown in FIG. 5, display circuit 100 comprises a transistor 512 and a light-emitting device 514 as the light emission source 110. Display circuit 100 further comprises a switching device 522 and a capacitor 524 as part of the driver 120, an optical sensor (OS) 530 and an optional isolation device 532 as sensor 130, and a voltage divider resistor 542 and a comparator 544 as part of the control unit 140. The OS 530 is coupled to a line selector output voltage $V_{OS1}$ and the voltage divider resistor 542 is coupled with OS 530 between $V_{OS1}$ and ground. The comparator 544 has a first input P1 coupled to the data input unit, a second input P2 coupled to a circuit node 546 between the OS 530 and the voltage divider resistor 542, and an output P3. The switching device 522 has a first control terminal G1*a* coupled to $V_{OS1}$, a second control terminal G1*b* coupled to the output P3 of comparator 544, an input DR1 coupled to a ramp voltage output VR, and an output S2 coupled to a control terminal G2 of transistor 512. The capacitor 524 is coupled between the control terminal G2 and a circuit node S2 between transistor 512 and light-emitting device 514. The capacitor 524 may alternatively be coupled between control terminal G2 of transistor 512 and ground.

Each OS 530 can be any suitable sensor having a measurable property, such as a resistance, capacitance, inductance, or the like parameter, property, or characteristic, dependent on received emissions. An example of OS 230 is a photosensitive resistor whose resistance varies with an incident photon flux. As another example, each OS 230 is a calibrated photon flux integrator, such as the one disclosed in commonly assigned U.S. patent application Ser. No. 11/016,372 entitled "Active-Matrix Display and Pixel Structure for Feedback Stabilized Flat Panel Display," filed on Dec. 17, 2004, which application is incorporated herein by reference in its entirety. Thus, each OS 230 may include at least one type of material that has one or more electrical properties changing according to the intensity of radiation falling or impinging on a surface of the material. Such materials include but are not limited to amorphous silicon (a-Si), cadmium selenide (CdSe), silicon (Si), and Selenium (Se). Other radiation-sensitive sensors may also or alternatively be used including, but not limited to, optical diodes, and/or optical transistors.

Isolation device 532 such as an isolation transistor may be provided to isolate the optical sensors 530. Isolation transistor 532 can be any type of transistor having first and second terminals and a control terminal, with conductivity between the first and second terminals controllable by a control voltage applied to the control terminal. In one embodiment, isolation transistor 532 is a TFT with the first terminal being a drain DR3, the second terminal being a source S3, and the control terminal being a gate G3. The isolation transistor 532 is serially coupled with OS 530 between $V_{OS1}$, and ground, with the control terminal of G3 connected to $V_{OS1}$, while the first and second terminals are connected to resistor 542 and OS 530, respectively, or to OS 530 and $V_{OS1}$, respectively. In the following discussion, OS 530 and isolation transistor 532 may together be referred to as sensor 130.

Light-emitting device 514 may generally be any light-emitting device known in the art that produces radiation such as light emissions in response to an electrical measure such as an electrical current through the device or an electrical voltage across the device. Examples of light-emitting device 514 include but are not limited to light emitting diodes (LED) and organic light emitting diodes (OLED) that emit light at any wavelength or a plurality of wavelengths. Other light-emitting devices may be used including electroluminescent cells, inorganic light emitting diodes, and those used in vacuum florescent displays, field emission displays and plasma displays. In one embodiment, an OLED is used as the light-emitting device 514.

Light-emitting device 514 is sometimes referred to as an OLED 514 hereafter. But it will be appreciated that the invention is not limited to using an OLED as the light-emitting device 514. Furthermore, although the invention is sometimes described relative to a flat panel display, it will be appreciated that many aspects of the embodiments described herein are applicable to a display that is not flat or built as a panel.

Transistor 512 can be any type of transistor having a first terminal, a second terminal, and a control terminal, with the current between the first and second terminals dependent on a control voltage applied to the control terminal. In one embodiment, transistor 512 is a TFT with the first terminal being a drain D2, the second terminal being a source S2, and the control terminal being a gate G2. Transistor 512 and light-emitting device 514 are serially coupled between a power supply $V_{DD}$ and ground, with the first terminal of transistor 512 connected to $V_{DD}$, the second terminal of transistor 512 connected to the light-emitting device 514, and the control terminal connected to ramp voltage output VR through switching device 522.

Figure 7:
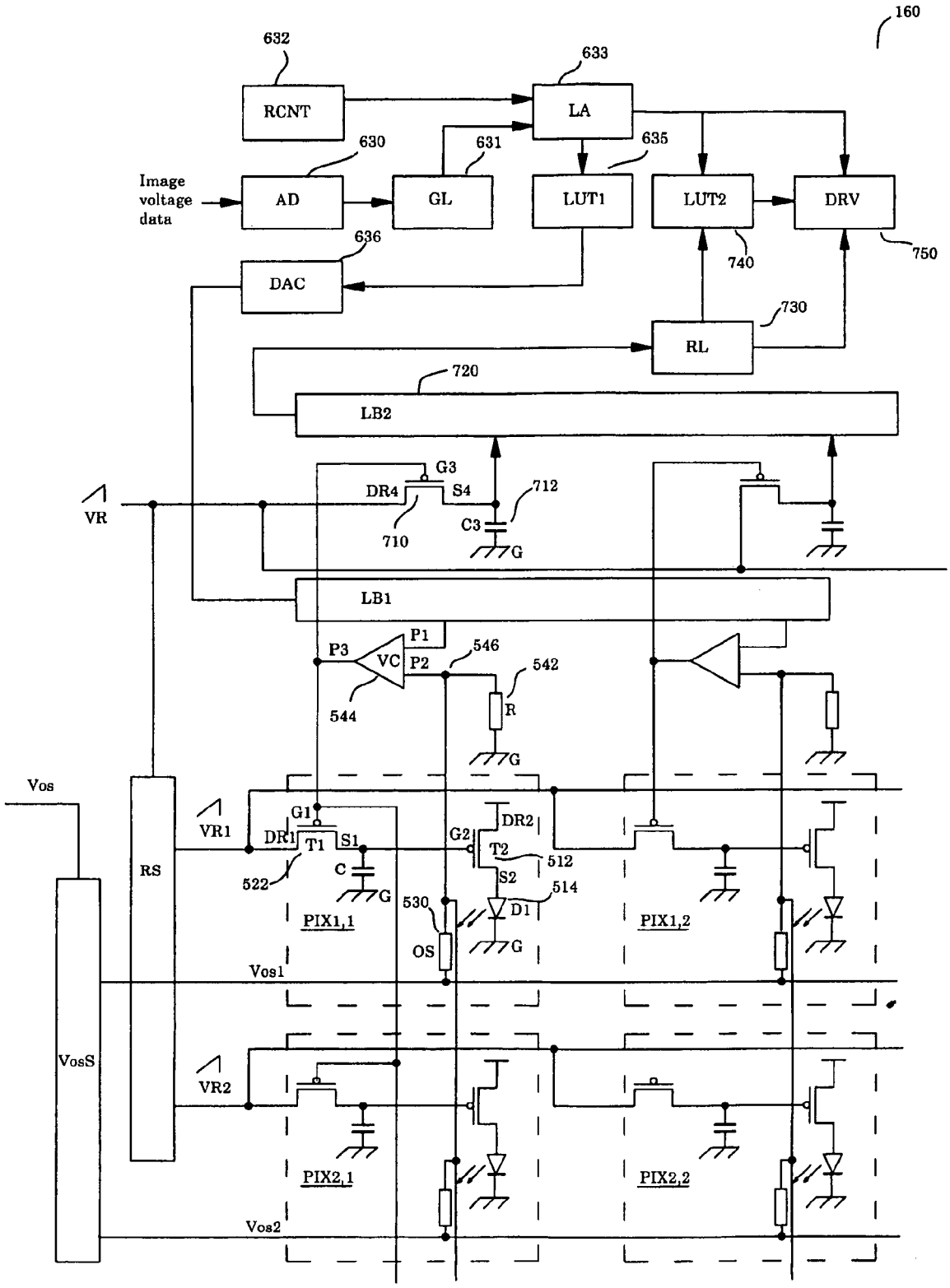
FIG. 7 is a diagram illustrating a power adjustment unit in the display circuit according to further embodiments of the present invention.

In one embodiment, switching device 522 is a double-gated TFT, that is, a TFT with a single channel but two gates G1*a* and G1*b*. The double gates act like an AND function in logic, because for the TFT 522 to conduct, logic highs need to be simultaneously applied to both gates. Although a double-gated TFT is preferred, any switching device implementing the AND function in logic is suitable for use as the switching device 522. For example, two serially coupled TFTs or other types of transistors may be used as the switching device 522. Use of a double-gated TFT or other device implementing the AND function in logic as the switching device 522 helps to reduce cross talk between pixels, as explained in more detail below. If cross talk is not a concern or other means are used to reduce or eliminate the cross talk, gate G1*a* and its connection to $V_{OS1}$ is not required, and a TFT with a single control gate connected to the output P3 of comparator 544 may be used as the switching device 522, as shown in FIG. 7.

Figure 4B:
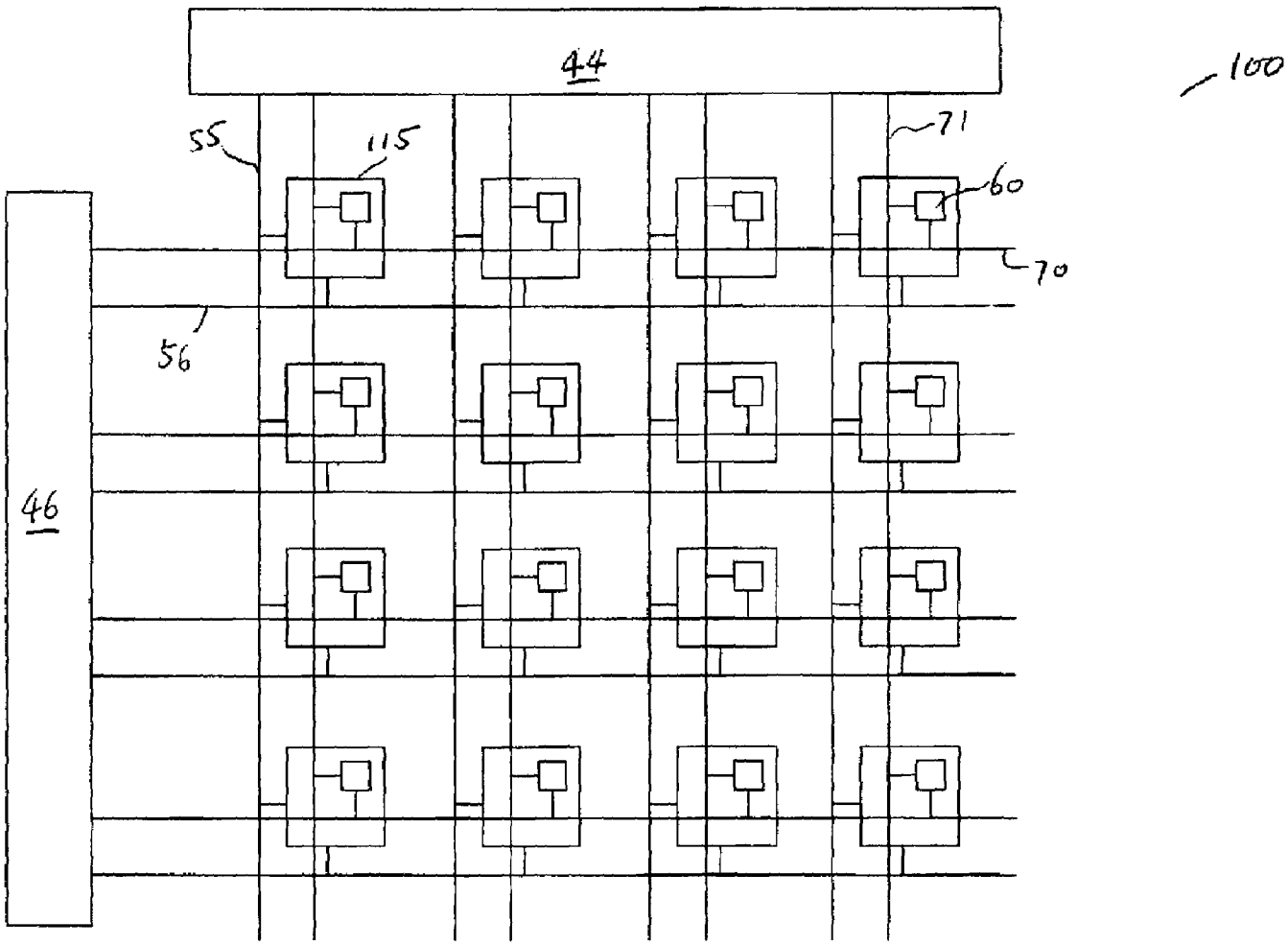
FIG. 4B is a block diagram of an emissive feedback circuit in a display having a plurality of pixels according to one embodiment of the present invention.

In one embodiment of the present invention, display 100 comprises a plurality of pixels 115 each having a driver 120 and a emission source 120, and a plurality of sensors 130 each corresponding to a pixel, as shown in FIG. 4B. Display 100 further comprises a column control circuit 44 and a row control circuit 46. Each pixel 115 is coupled to the column control circuit 44 via a column line 55 and to the row control circuit 46 via a row line 56. Each sensor 130 is coupled to the row control circuit 46 via a sensor row line 70 and to the column control circuit 44 via a sensor column line 71. In one embodiment, at least parts of the control unit 140, the data input unit 150 and the power adjustment unit 160 are comprised in the column control circuit 44.

In one embodiment, each sensor 130 is associated with a respective pixel 115 and is positioned to receive a portion of the light emitted from the pixel. Pixels are generally square, as shown in FIG. 4B, but can be any shape such as rectangular, round, oval, hexagonal, polygonal, or any other shape. If display 11 is a color display, pixel 33 can also be subpixels organized in groups, each group corresponding to a pixel. The subpixels in a group should include a number (e.g., 3) of subpixels each occupying a portion of the area designated for the corresponding pixel. For example, if each pixel is in the shape of a square, the subpixels are generally as high as the pixel, but only a fraction (e.g., ⅓) of the width of the square. Subpixels may be identically sized or shaped, or they may have different sizes and shapes. Each subpixel may include the same circuit elements as pixel 115 and the sub-pixels in a display can be interconnected with each other and to the column and row control circuits 44 and 46 just as the pixels 115 shown in FIG. 4B. In a color display, a sensor 130 is associated with each subpixel. In the following discussions, the reference of a pixel can mean both a pixel or subpixel.

The row control circuit 46 is configured to activate a selected row of sensors 60 by, for example, raising a voltage on a selected sensor row line 70, which couples the selected row of sensors to the row control circuit 46. The column control circuit 44 is configured to detect changes in the electrical parameters associated with the selected row of sensors and to control the luminance of the corresponding row of pixels 115 based on the changes in the electrical parameters. This way, the luminance of each pixel can be controlled at a specified level based on feedbacks from the sensors 130. In other embodiments, the sensors 130 may be used for purposes other than or in addition to feedback control of the pixel luminance, and there may be more or less sensors 130 than the pixels or subpixels 115 in a display.

Figure 4C:
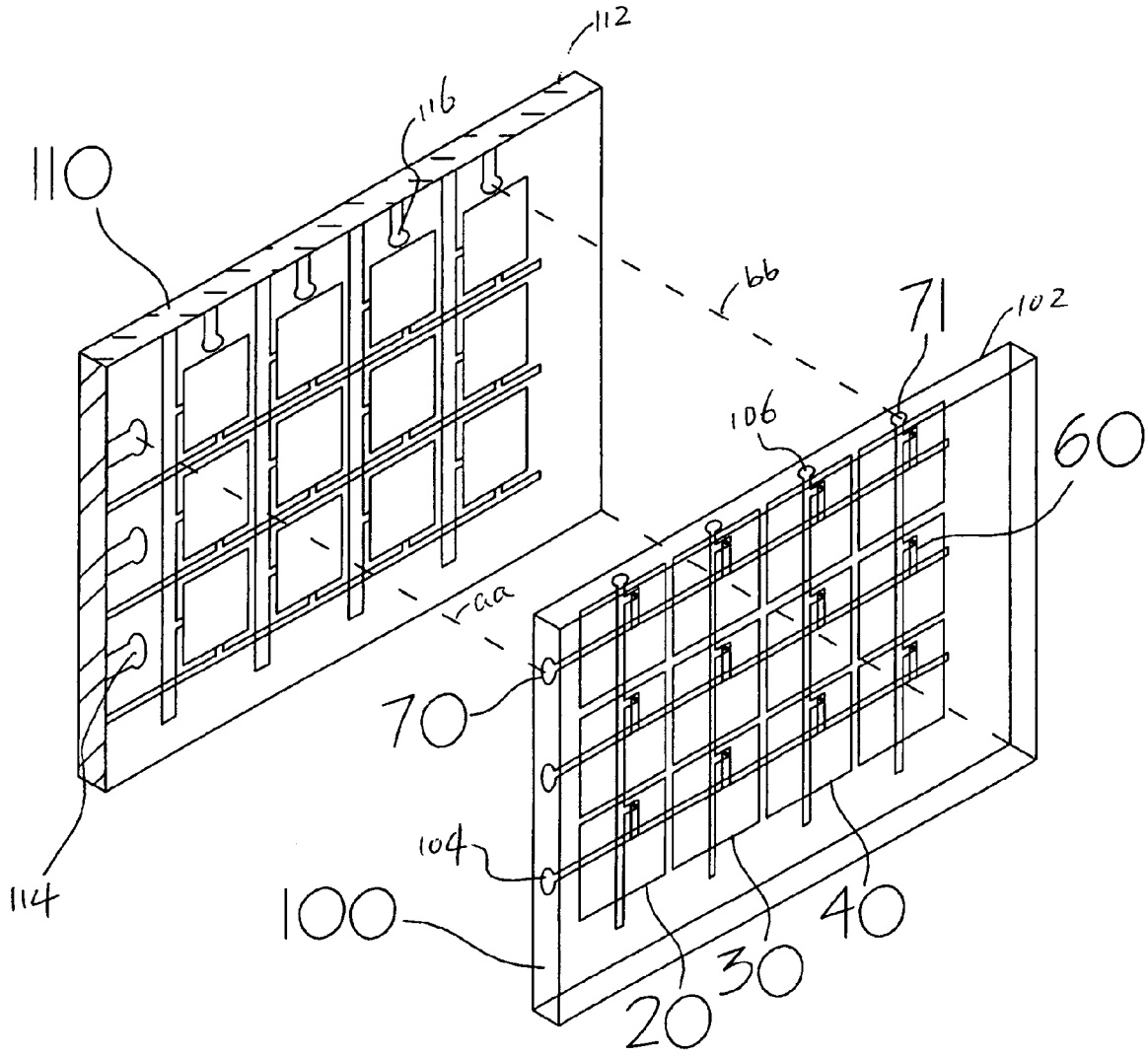
FIG. 4C is a block diagram of two separate components in an emissive feedback circuit according to one embodiment of the present invention.

The sensors and the pixels can be formed on a same substrate, or, they can be formed on different substrates. In one embodiment, display 100 comprises a sensor component 100 and a display component 110, as illustrated in FIG. 4C. The display component 110 comprises pixels 115, the column control circuit 44, the row control circuit 46, the column lines 55, and the row lines 56 formed on a first substrate 112, while the sensor component 100 comprises the sensors 130, the sensor row lines 70, and the sensor column lines 71 formed on a second substrate 102. The sensor component 100 may also comprise color filter elements 20, 30, and 40 when the sensors 130 are integrated with a color filter for the display, as described in related patent application Ser. No. 10/872,344.

Figure 1:
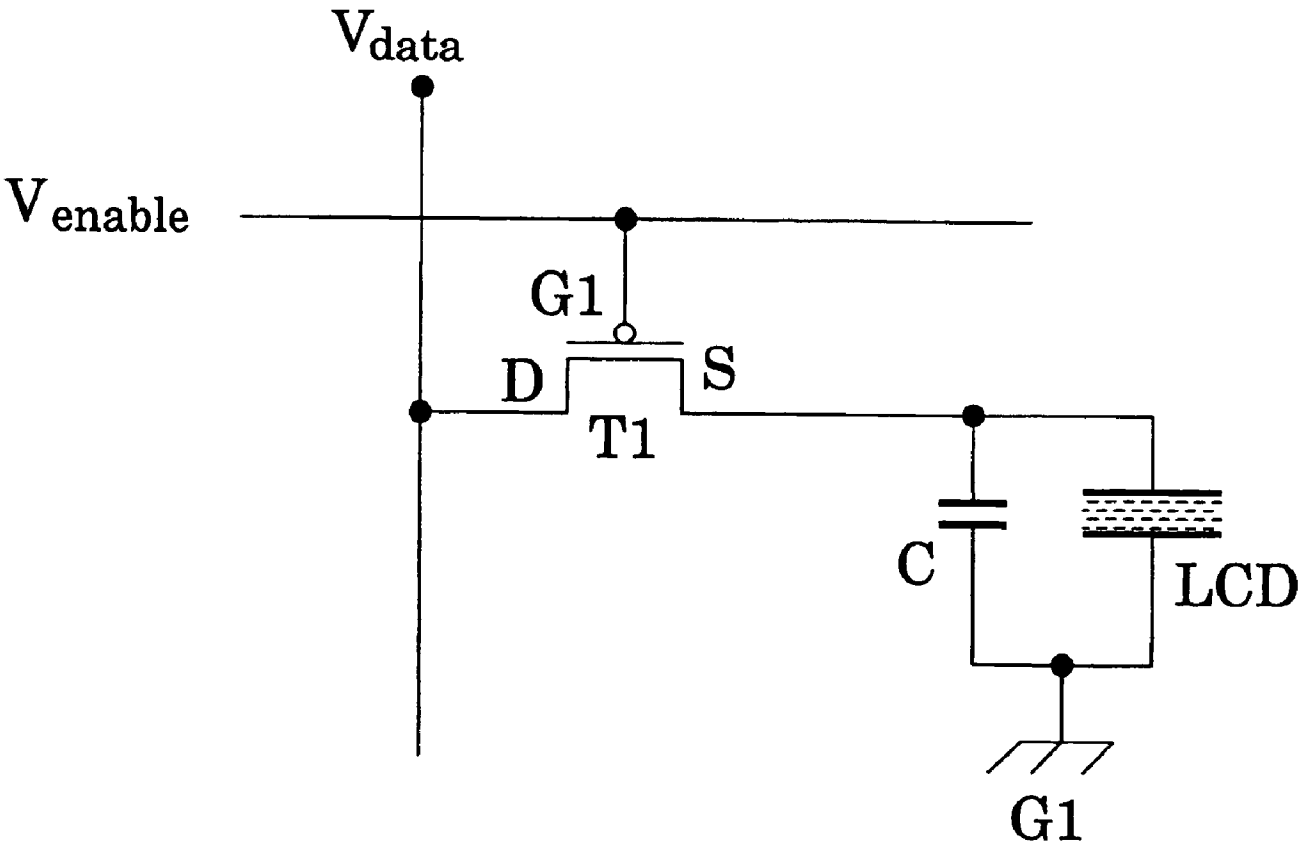
FIG. 1 is a diagram illustrating a conventional AMLCD pixel driving circuit.
Figure 2:
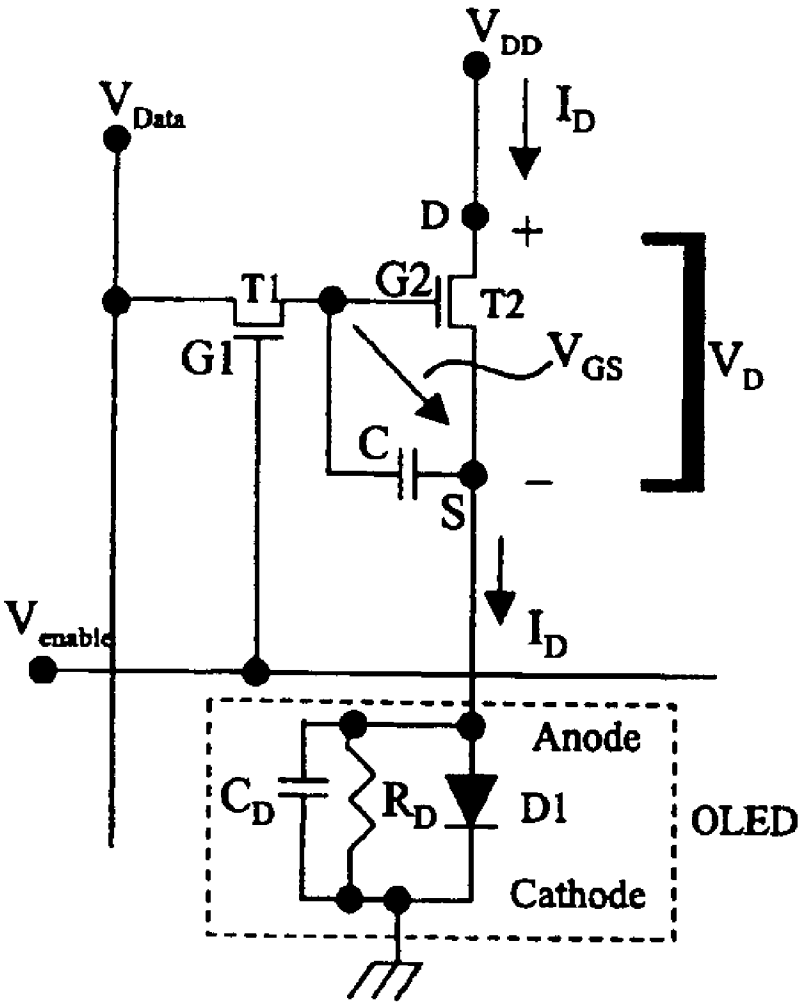
FIG. 2 is a circuit schematic illustrating a conventional AMOLED pixel driving circuit.
Figure 3:
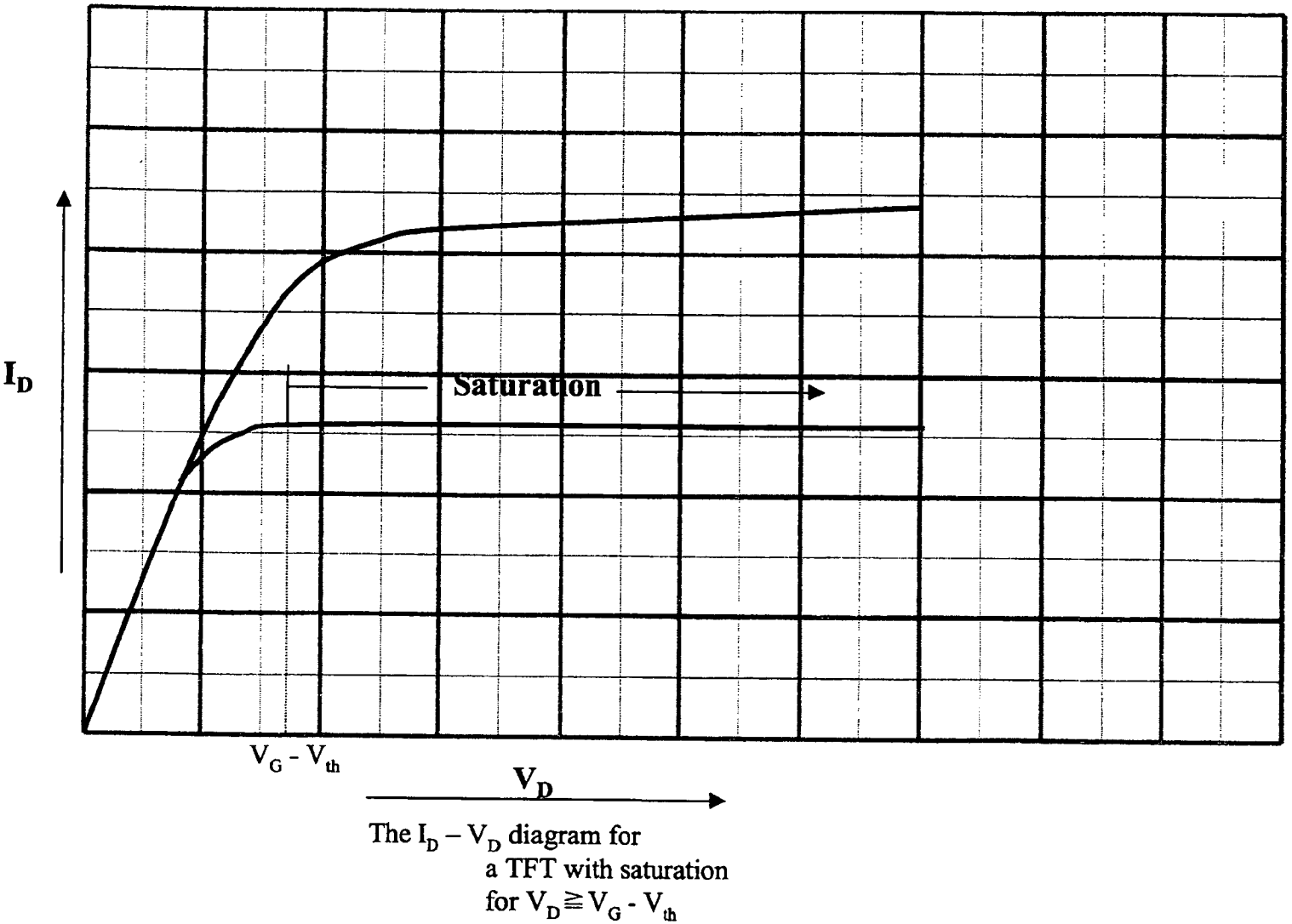
FIG. 3 is a graph of drain current versus source-drain voltage in a power TFT.

When the two components are put together to form display 11, electrical contact pads or pins 114 on display component 110 are mated with electrical contact pads 104 on filter/sensor plate 100, as indicated by the dotted line aa, in order to connect the sensor row lines 70 to the row control circuit 46. Likewise, electrical contact pads or pins 116 on display component 110 are mated with electrical contact pads 106 on filter/sensor plate 100, as indicated by the dotted line bb, in order to connect the sensor column lines 71 to the column control circuit 44. It is understood that display component 110 can be one of any type of displays including but not limited to LCDs, electroluminescent displays, plasma displays, LEDs, OLED based displays, micro electrical mechanical systems (MEMS) based displays, such as the Digital Light projectors, and the like. For ease of illustration, only one set of column lines 55 and one set of row lines 56 for the display component 100 are shown in FIG. 1B. In practice, there may be more than one set of column lines and/or more than one set of row lines associated with the display component 110. For example, in an OLED-based active matrix emissive display, as discussed below, display component 110 may comprise another set of row lines connecting each pixel 33 to a respective one of the contact pads 114.

Figure 6:
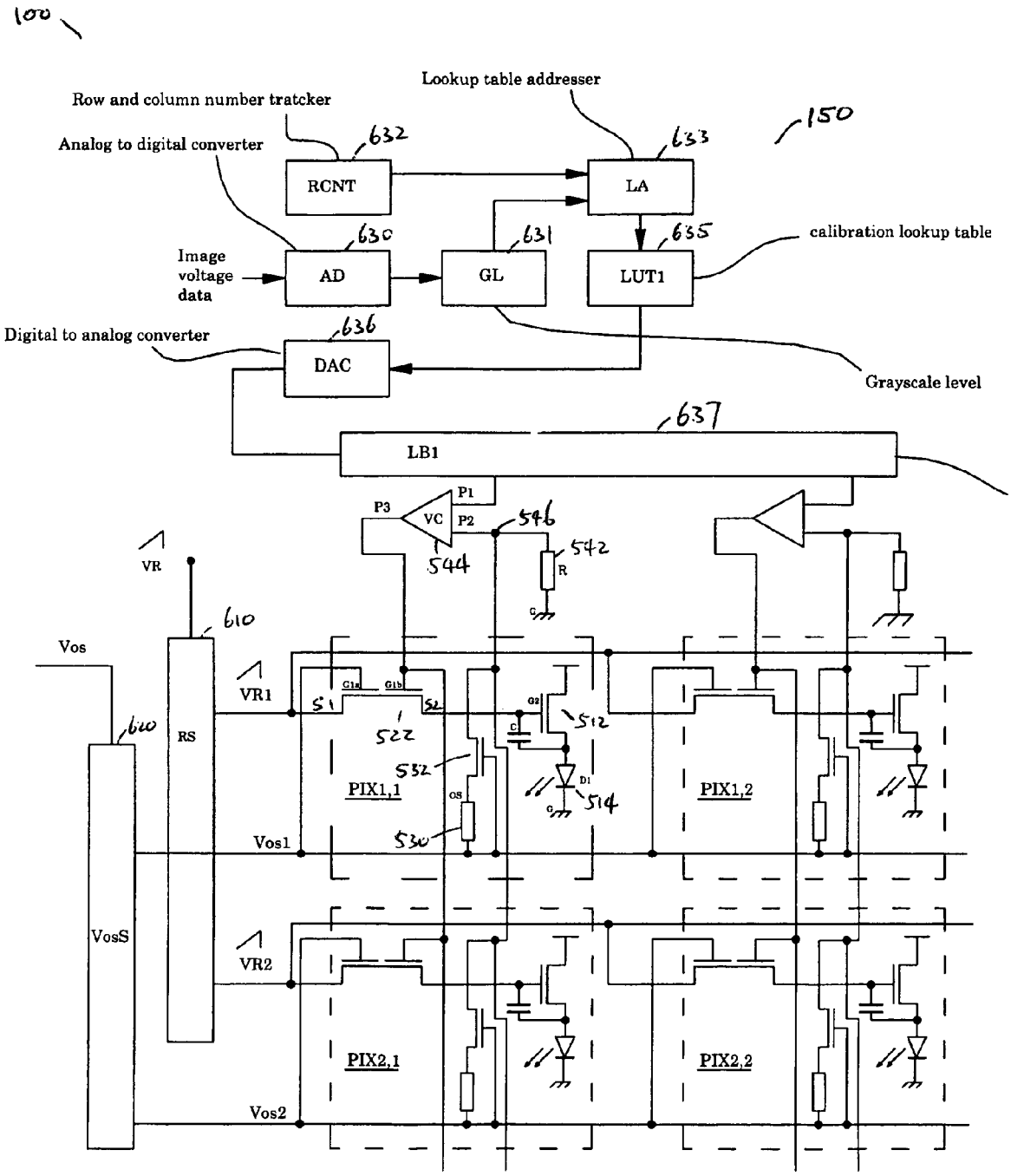
FIG. 6 is a diagram of a larger portion of the display circuit according to an embodiment of the present invention.

FIG. 6 illustrates one implementation of one embodiment of display 100. As shown in FIG. 6, display 100 comprises a plurality of pixels 500 arranged in rows and columns, with pixels PIX1,1, PIX1,2, etc., in row 1, pixels PIX2,1, PIX2,2, etc., in row 2, and so on for the other rows in the display. Each pixel 500 comprises a transistor 512, a light-emitting device 514, a switching device 522, and a capacitor 524. FIG. 6 also shows a sensor array comprising a plurality of sensors arranged in rows and columns, each corresponding to a pixel and each comprising an optical sensor OS 530 and an isolation transistor 532.

Still referring to FIG. 6, display 100 further comprises ramp selector (RS) 610 configured to receive a ramp voltage VR and to select one of row lines, VR1, VR2, etc., to output the ramp voltage VR. Each of lines VR1, VR2, etc., is connected to drain D1 of switching device 522 in each of a corresponding row of pixels 500. Circuit 100 further comprises a line selector ($V_{OS}$S) configured to receive a line select voltage Vos and to select one of sensor row lines, $V_{OS}$1, $V_{OS}$2, etc., to output the line select voltage $V_{OS}$. Each of lines $V_{OS}$1, $V_{OS}$2, etc., is connected to the optical sensors 530 and to gate G1*a* of switching device 522 in each of a corresponding row of pixels 500. RS 610 and VosS 620 are part of the row control circuit 46 and can be implemented using shift registers.

Each sensor comprising the OS 530 and the TFT 532 may be part of a pixel in the display and formed on a same substrate the pixels are formed. Alternatively, the sensors are fabricated on a different substrate from the substrate on which the pixels are formed, as shown in FIG. 4C. In this case, another set or row lines (not shown) are provided to allow gate G1*a* to be connected to contact pads 114 and thus to the sensor row lines Vos1, Vos2, etc., when the two substrates are mated together.

FIG. 6 also shows that display comprises a plurality of comparators 544 and resistors 522 each being associated with a column of pixels 500. FIG. 6 further shows a block diagram of data input unit 150, which comprises an analog to digital converter (A/D) 630 configured to convert a received image voltage data to a corresponding digital value, an optional grayscale level calculator (GL) 631 coupled to the A/D 630 and configured to generate a grayscale level corresponding to the digital value, a row and column tracker unit (RCNT) 632 configured to generate a line number and column number for the image voltage data, a calibration look-up table addresser (LA) 633 coupled to the RCNT 632 and configured to output an address in the display circuit 100 corresponding to the line number and column number, and a first look-up table (LUT1) 635 coupled to the GL 631 and the LA 633. Data input unit 150 further comprises a digital to analog converter (DAC) 636 coupled to the LUT1 635 and a first line buffer (LB1) 637 coupled to the DAC 636. In one embodiment, comparators 544, resistors 522, and at least part of data input unit 150 are included in the column control circuit 44.

In one embodiment, LUT1 635 stores calibration data obtained during a calibration process for calibrating against a light source having a known luminance each optical sensor in the display circuit 100. Related patent applications Ser. No. 10/872,344 and U.S. patent application Ser. No. 10/841,198, supra, describes an exemplary calibration process, which description is incorporated herein by reference. The calibration process results in a voltage divider voltage level at circuit node 546 in each pixel for each grayscale level. As a non-limiting example, an 8-bit grayscale has 0–256 levels of luminance with the $255^{th}$ level being at a chosen level, such as 300 nits for a Television screen. The luminance level for each of the remaining 255 levels is assigned according to the logarithmic response of the human eye. The zero level corresponds to no emission. Each value of brightness will produce a specific voltage on the circuit node 546 between optical sensor OS 530 and voltage divider resistor 542. These voltage values are stored in lookup table LUT1 as the calibration data. Thus, based on the address provided by LA 633 and the gray scale level provided by GL 631, the LUT1 635 generates a calibrated voltage from the stored calibration data and provides the calibrated voltage to DAC 636, which converts the calibrated voltage into an analog voltage value and downloads the analog voltage value to LB1 637. LB1 637 provides the analog voltage value as a reference voltage to input P1 of comparator 544 associated with the column corresponding to the address.

Initially, all of lines $V_{OS}$1, $V_{OS}$2, etc., are at zero or even a negative voltage depending on specific application. So the switching device 522 in each pixel 500 is off no matter what the output P3 of the comparator 544 is. Also, isolation transistor 532 in each pixel is off so that no sensor is connected to P2 of the comparator 544. Also note that the voltage on P2 of voltage comparator 544 is zero (or at ground) because there is no current flowing through the resistor 542, which is connected to ground. In one embodiment, comparator 544 is a voltage comparator that compares the voltage levels at its two inputs P1 and P2 and generates at its output P3 a positive supply rail (e.g., +10 volts) when P1 is larger than P2 and a negative supply rail (e.g., 0 volts) when P1 is equal of less than P2. The positive supply rail corresponds to a logic high for the switching device 522 while negative supply rail corresponds to a logic low for the switching device 522. Initially, before OLED 514 emits light, OS 530 has a maximum resistance to current flow; and voltage on input pin P2 of VC 544 is minimum because the resistance R of voltage divider resistor 542 is small compared to the resistance of OS 530. So, as the reference voltages for the first row (row 1), which includes pixels PIX1,1, PIX1,2, etc., are written to line buffer 657, all of the gates G1*b* in the pixels are opened because input P1 in each comparator 544 is supplied with a reference voltage while input P2 in each comparator 544 is grounded, causing comparator 544 to generate the positive supply rail at output P3.

Image data voltages for row 1 of the display 100 are sent to the A/D converter 630 serially and each is converted to a reference voltage and stored in LB1 637 until LB1 stores the reference voltages for every pixel in the row. At about the same time, shift register $V_{OS}$ 620 sends the $V_{OS}$ voltage (e.g., +10 volts) to line Vos1, turning on gate G1*b* of each switching device 524 in row 1, and thus, the switching devices 522 themselves (since gate G1*a* is already on). The voltage $V_{OS}$ on line Vos1 is also applied to OS 530 and to the gate G3 of transistor 532 in each of the first row of pixels, causing transistor 532 to conduct and current to flow through OS 530. Also at about the same time, shift register RS 610 sends the ramp voltage VR (e.g., from 0 to 10 volts) to line VR1, which ramp voltage is applied to storage capacitor 524 and to the gate G2 of transistor 512 in each pixel in row 1 because switching device 522 is conducting. As the voltage on line VR1 is ramped up, the capacitor 524 is increasingly charged, the current through transistor 512 and OLED 514 in each of the first row of pixels increases, and the light emission from the OLED also increases. The increasing light emission from the OLED 514 in each pixel in row 1 falls on OS 530 associated with the pixel and causes the resistance associated with the OS 530 to decrease, and thus, the voltage across resistor 542 or the voltage at input P2 of comparator 544 to increase.

This continues in each pixel in row 1 as the OLED 514 in the pixel ramps up in luminance with the increase of ramp voltage VR until the OLED 514 reaches the desired luminance for the pixel and the voltage at input P2 is equal to the reference voltage at input P1 of comparator 544. In response, output P3 of comparator 544 changes from the positive supply rail to the negative supply rail, turning off gate G1*b* of switching device 522 in the pixel, and thus, the switching device itself. With the switching device 522 turned off, further increase in VR is not applied to gate G of transistor 512 in the pixel, and the voltage between gate G2 and the second terminal S2 of transistor 512 is held constant by capacitor 524 in the pixel. Therefore, the emission level from OLED 514 in the pixel is frozen or fixed at the desired level as determined by the calibrated reference voltage placed on pin, P1 of the voltage comparator 544 associated with the pixel.

The duration of time that the ramp voltage VR1 takes to increase to its full value is called the line address time. In a display having 500 lines and running at 60 frames per second, the line address time is approximately 33 micro seconds or shorter. Therefore, all the pixels in the first row are at their respective desired emission levels by the end of the line address time. And this completes the writing of row 1 in the display 100. After row 1 is written, both horizontal shift registers, $V_{OS}$S 620 and RS 610 turn off lines VR1 and Vos1, respectively, causing switching device 522 and isolation transistor 532 to be turned off, thereby, locking the voltage on the storage capacitor 524 and isolating the optical sensors 530 in row 1 from the voltage comparators 544 associated with each column. When this happens, the voltage on pin P2 of each comparator 544 goes to ground as no current flows in resistor R, causing the output P3 of the voltage comparator 544 to go back to the positive supply rail, turning gate G1*b* of switching device 522 in each related pixel back on, ready for the writing of the second row of pixels in display 100.

During the writing of the second row, image data associated with the second row is supplied to A/D 630, ramp selector RS 610 selects line VR2 to output ramp voltage VR, line selector $V_{OS}$S 620 selects line $V_{OS}$2 to output line select voltage Vos, and the previous operation is repeated for the second row of pixels until they are turned on. Ramp selector RS 610 and $V_{OS}$S 620 move to row three and so on until all rows in the display have been turned on, and then the frame repeats. In the embodiments depicted by FIG. 6, each switching device 522 has double gates, Gate G1*a* and Gate G1*b*, and gate G1*a* of each switching device 522 in row 1 is held by line $V_{OS}$1. So, during the writing of subsequent rows, while gate G1*b* may conduct, the switching devices 522 in row 1 are kept off because $V_{OS}$1 is not selected. Thus, capacitor 524 in each pixel in row 1 is kept disconnected from the capacitors 524 in the other pixels in row 1. This eliminates cross talk between capacitors 524 in different pixels in the row that has just be written, so that each pixel in the row continues to output the desired emission level during the writing of subsequent rows.

Because the luminance of each pixel 500 in the display 100 does not depend on a voltage-current relationship associated with transistor 512, but is controlled by a specified image grayscale level and a feedback of the pixel luminance itself, the embodiments described above allow transistor 512 to operate in the unsaturated region, and thus, save power for the operation of display 100. Using the exemplary OLED and TFT parameters discussed in the background section, a $V_{DD}$ as low as 9 volts may be sufficient to operate display 100 because transistor TFT 512 does not need to operate in saturation mode. Out of the 9 volts, about 6 volts are used to produce 1 μA of current in OLED 514 at maximum aging of the OLED 514, about 2 additional volts are required for the threshold voltage drift over the life of the display, and a minimum of about 1 volt is used as the source/drain voltage across transistor 512. Thus, the power dissipation of power TFT 512 is now about about 5 microwatts instead of about 9.2 microwatts as required by conventional power TFTs operation in saturation mode. This is a significant power savings of about 46% for the power TFTs.

Using the following parameters associated with a typical power TFT:

$V_{th} \approx 1$ V $\mu \approx 0.75$ cm$^2$/V·sec $\epsilon_r \approx 4$ $w \approx 25$ μm $1 \approx 5$ μm $d \approx 0.18$ μm where μ is the effective electron mobility, $\epsilon_0$ being the permittivity of free space, $\epsilon_r$ is the dielectric constant of the gate dielectric, w is the TFT channel width, 1 is the TFT channel length, d is the gate dielectric thickness, and $V_{th}$ is the threshold voltage, it can be estimated that, the maximum gate voltage $V_{G2}$ for a typical power TFT 512 to operate in the unsaturated region at 1 μA current should be about 15 volts. Thus, the maximum value in ramp voltage VR should be set above 15 V. The required gate voltage for power TFT 512 is higher when TFT 512 is operating in the unsaturated region, but this does not create a significant power dissipation issue.

As described above, additional voltages or voltage range capacity may advantageously be included in the power supply $V_{DD}$ to allow for degradation in the efficiency of the OLED D1 and for threshold voltage drift in power TFT 512. These additional voltages may amount to as much as three to four volts, which results in significant power dissipation. Further savings in power can be attained by using a variable power supply, which allows the voltage $V_{DD}$ to be set low initially and be increased as pixels age, or threshold voltage drifts, or both.

FIG. 7 illustrates the power adjustment unit 160 in display 100 according to one embodiment of the present invention. As shown in FIG. 7, power adjustment unit 160 comprises a plurality of transistors 710 each associated with a column of pixels and a plurality of capacitors 712 each coupled to a respective one of the transistors 710. Each transistor 710 can be any transistor having first and second terminals and a control terminal, with the conductivity between first and second terminals controllable by a voltage applied to the control terminal. In one embodiment, each transistor 710 is a TFT with the first terminal being the drain D4, the second terminal being the source D4, and the control terminal being the gate G4 of the TFT. Each capacitor 712 is coupled between a source S4 of a respective one of the TFTs 710 and ground. The gate G4 of each TFT 710 is connected to output P3 of a respective one of the voltage comparators 544, and the drain D4 of the TFT is connected to the ramp voltage output VR.

Power adjustment unit 160 further comprises a line buffer (LB2) 720, a ramp logic block (RL) 730, a storage medium 740 storing therein a look-up table (LUT2), and a storage medium 750 storing therein a differential ramp voltage table (DRV). During operation, every time a ramp voltage value is locked on the storage capacitors 524 in a pixel in a row being addressed, the same voltage is locked on the storage capacitors 712 at the head of the column including the pixel. These locked ramp voltages is up loaded to LB2 720.

The first time the display is used, the set of ramp voltages loaded in LB2 720 represent the initial and new state of the display before any pixel degradation or TFT threshold voltage drifts have occurred. This initial set of ramp voltages is stored in look up table LU2 740. The initial ramp voltage set is guided to look up table LUT2 740 by Ramp logic RL 730. During subsequent use of the display, the ramp voltages loaded in LB2 are compared to the initial set of ramp voltages stored in lookup table LUT2 and the difference is stored in DRV 750. As the display ages, higher gate voltage at the power TFT 512 would be required to produce the same current through OLED 514 or the same brightness of OLED 514. Therefore, the set of values in DRV 750 represents the aging of the display and these values should increase with the continued usage of display 100.

As the differential ramp voltages increase, voltage $V_{DD}$ output from the variable power supply 170 is also increased using a known technique to compensate for the pixel aging and power TFT threshold voltage drifts. There are many ways to determine when to increase $V_{DD}$ and how much increase should be made. As a non-limiting example, $V_{DD}$ can be increased by a certain increment (e.g., 0.25 volts) when a certain percentage (e.g., 20%) of the differential ramp voltages stored in DRV 750 have each changed by more than a certain amount (e.g., 0.25 volts). As another example, $V_{DD}$ can be increased by a certain increment (e.g., 0.25 volts) when an average of the differential ramp voltages stored in DRV 750 has increased by a certain amount (e.g., 0.25 volts).

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A display having a plurality of pixels, each pixel comprising:

a light-emitting device configured to emit light in response to a current flowing through the light-emitting device, a luminance of the light-emitting device being dependent upon the current;

a transistor coupled to the light-emitting device and configured to provide the current through the light-emitting device, the current increasing with a ramp voltage applied to a control terminal of the transistor; and a first switching device configured to switch off in response to the luminance of the light-emitting device having reached a specified level, thereby disconnecting the ramp voltage from the transistor; and wherein the first switching device is further configured to stay off thereby allowing the luminance of the light-emitting device to be kept at the specified level until the pixel is rewritten.

2. The display of claim 1, wherein the light-emitting device is an organic light-emitting diode.

3. The display of claim 1, wherein each pixel further comprises a capacitor coupled to the transistor and configured to keep the luminance of the light-emitting device at the specified level after the ramp voltage is disconnected from the transistor.

4. The display of claim 1, further comprising an optical sensor associated with each pixel, the optical sensor positioned to receive a portion of the light from the light-emitting device and having an electrical parameter dependent on the luminance of the light-emitting device.

5. The display of claim 4, wherein the pixels are arranged in rows and columns and the display further comprises a resistor associated with each column and serially coupled with the optical sensor in each of the pixels in the column.

6. The display of claim 5, wherein each pixel further comprises a second switching device serially coupled with the optical sensor and having a control terminal connected to a conductive line associated with a row of pixels.

7. The display of claim 6, wherein the first and second switching devices are thin-film transistors.

8. The display of claim 4, wherein the pixels are arranged in rows and columns and the first switching device in each pixel has a first control terminal coupled to a conductive line associated with a row of pixels and a second control terminal connected to a voltage that is dependent upon the luminance of the light-emitting device.

9. The display of claim 8, further comprising a voltage comparator associated with each column of pixels and having an output connected to the second control terminal of the first switching device in each pixel in the column, a first input receiving a reference voltage corresponding to a specified luminance of a pixel in the column, and a second input connected to the optical sensor associated with each pixel in the column.

10. A method for controlling the brightness of a pixel in a display, the method comprising:

switching on a switching device by applying a first control voltage to a first control terminal and a second control voltage to a second control terminal of the switching device;

applying a ramp voltage through the switching device to a gate of a transistor serially coupled with the light-emitting device thereby causing a luminance of the light-emitting device to increase with the ramp voltage; and illuminating an optical sensor with the light from the light-emitting device thereby causing an electrical parameter associated with the optical sensor to change according to the luminance of the light-emitting device; and wherein the second control voltage is dependent on the electrical parameter and changes to a different value in response to the luminance of the light-emitting device having reached a specified level for the pixel, thereby switching off the switching device.

11. The method of claim 10, further comprising:

charging a capacitor coupled to the transistor with the ramp voltage, the capacitor keeping the brightness of the light at the specified level after the switching device is switched off.

12. The method of claim 10, further comprising:

changing the first control voltage to keep the switching device off and the brightness of the light at the specified level.

13. The method of claim 10, wherein the transistor and the light-emitting device are serially coupled with each other between a variable voltage source and ground, and the method further comprising:

varying a voltage output from the variable voltage source as the display ages.

14. The method of claim 13, wherein varying the voltage output comprising:

recording a value of ramp voltage required to cause the light-emitting device in each pixel in the display to reach the specified level of luminance for the pixel; and varying the voltage output based on a statistical measure calculated from the changes in the recorded values for some or all of the pixels in the display.

15. A display having a plurality of pixels, each pixel comprising:

a light-emitting device configured to emit light in response to a current flowing through the light-emitting device, a luminance of the light-emitting device being dependent upon the current;

a transistor configured to provide the current through the light-emitting device, the current increasing with a ramp voltage applied to a control terminal of the current source; and a first switching device configured to disconnect the ramp voltage from the transistor in response to the luminance of the light-emitting device having reached a specified level; and wherein the transistor and the light-emitting device are serially coupled with each other between a variable voltage source and ground.

16. The display of claim 15, wherein the variable voltage source is configured to output a voltage that changes as the display ages.

17. The display of claim 16, wherein the voltage output from the variable voltage source changes based on a statistical evaluation of the changes in ramp voltages required to cause the luminance of the light-emitting devices to reach specified levels in some or all of the pixels in the display.

18. The display of claim 15, further comprising:

a storage capacitor configured to be charged by the ramp voltage;

a second switching device configured to disconnect the second ramp voltage from the capacitor in response to the luminance of the light-emitting device having reached the specified value; and a buffer configured to record the voltage across the storage capacitor after the storage capacitor is disconnected from the second ramp voltage.

19. The display of claim 15, further comprising:

a capacitor coupled to the transistor and configured to be charged by the ramp voltage until the luminance of the light-emitting device has reached the specified level and to keep the luminance of the light-emitting device at the specified level.

20. A display having a plurality of pixels, each pixel comprising:

a light-emitting device;

means for allowing a ramp voltage to control a current through the light-emitting device so that the luminance of the light-emitting device increases with the ramp voltage;

means for disconnecting the ramp voltage from the light-emitting device in response to the luminance having reached a specified level; and means for keeping the luminance at the specified level after the ramp voltage is disconnected; and wherein the means for keeping comprises means for isolating the pixel from other pixels in the display.

* * * * *